US008046864B2

(12) United States Patent
Baertschi et al.

(10) Patent No.: US 8,046,864 B2
(45) Date of Patent: Nov. 1, 2011

(54) TOOTHBRUSH WITH RECESSES

(75) Inventors: Armin Baertschi, Winznau (CH); Beat Huber, Bueron (CH)

(73) Assignee: Trisa Holding AG, Triengen (CH)

( * ) Notice: Subject to any disclaimer, the term of this patent is extended or adjusted under 35 U.S.C. 154(b) by 995 days.

(21) Appl. No.: 11/658,915

(22) PCT Filed: Jun. 1, 2005

(86) PCT No.: PCT/EP2005/005858

§ 371 (c)(1),
(2), (4) Date: Jan. 30, 2007

(87) PCT Pub. No.: WO2006/012938

PCT Pub. Date: Feb. 9, 2006

(65) Prior Publication Data

US 2009/0188063 A1 Jul. 30, 2009

(30) Foreign Application Priority Data

Jul. 31, 2004 (EP) ..... 04018191

(51) Int. Cl.
*A46B 9/04* (2006.01)

(52) U.S. Cl. ..... 15/167.1; 15/110; 15/144.1; 15/143.1

(58) Field of Classification Search ..... 15/167.1, 15/110, 144.1, 143.1
See application file for complete search history.

(56) References Cited

U.S. PATENT DOCUMENTS

| | | | | |
|---|---|---|---|---|
| 1,840,246 | A | 1/1932 | Newman | |
| 1,860,924 | A | 5/1932 | Cooke | |
| 2,263,885 | A | 11/1941 | McGauley | |
| 4,979,782 | A | 12/1990 | Weihrauch | |
| 5,272,784 | A * | 12/1993 | Levin | 15/167.1 |
| D377,715 | S * | 2/1997 | Baldwin | D4/104 |
| 6,016,587 | A | 1/2000 | Savitt et al. | |
| 6,273,719 | B1 * | 8/2001 | Whitman | 433/141 |
| 6,286,173 | B1 | 9/2001 | Briones | |
| 6,308,367 | B1 * | 10/2001 | Beals et al. | 15/167.1 |
| 6,553,604 | B1 * | 4/2003 | Braun et al. | 15/167.1 |
| 6,779,851 | B2 | 8/2004 | Bouchiere | |
| 7,297,303 | B2 * | 11/2007 | Kraemer | 264/243 |

FOREIGN PATENT DOCUMENTS

| | | |
|---|---|---|
| DE | 42 22 931 CI | 12/1993 |
| DE | 200 06 311 U1 | 9/2001 |
| EP | 0 346 646 A2 | 12/1989 |
| EP | 1 397 976 A1 | 3/2004 |
| WO | WO 02/15740 A1 | 2/2002 |

* cited by examiner

*Primary Examiner* — Shay Karls
(74) *Attorney, Agent, or Firm* — Oliff & Berridge, PLC

(57) ABSTRACT

The toothbrush body according to the invention has on its top side a hand-supporting section with at least one longitudinal support strip which extends along the longitudinal axis of a handle part and next to which is located at least one recess which extends laterally from the top side to a bottom side. The recesses can take the form of holes located between two longitudinal support strips or of open lateral recesses formed in the broad sides of the toothbrush body.

19 Claims, 5 Drawing Sheets

Fig. 1
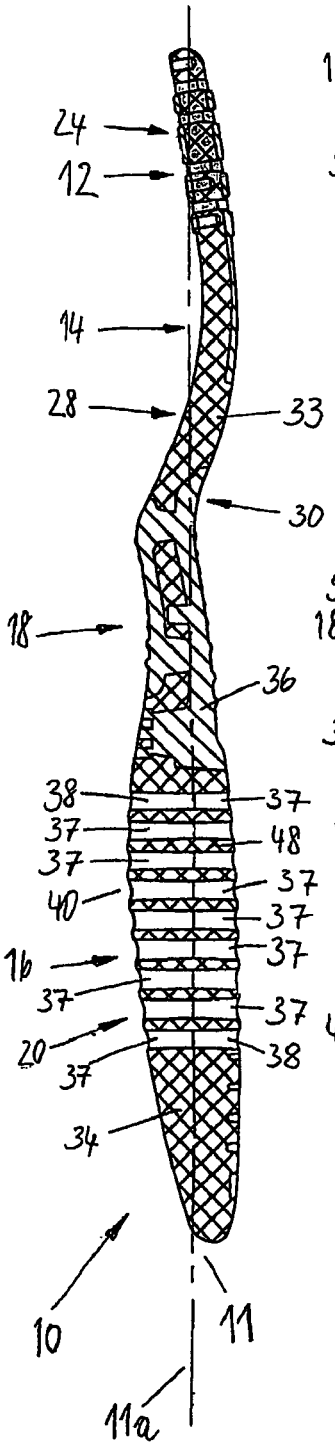
Fig. 2
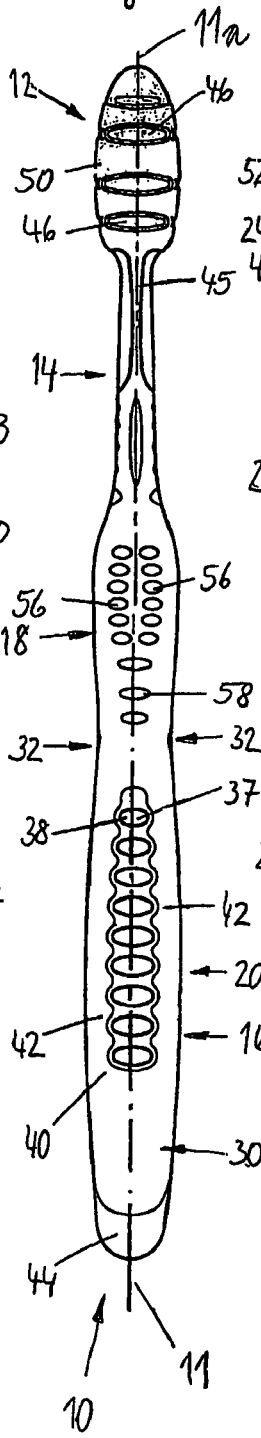
Fig. 3
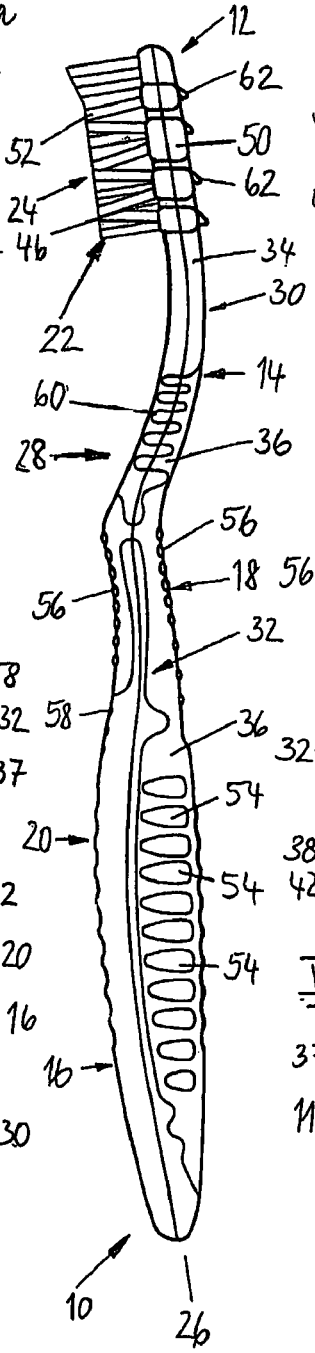
Fig. 4
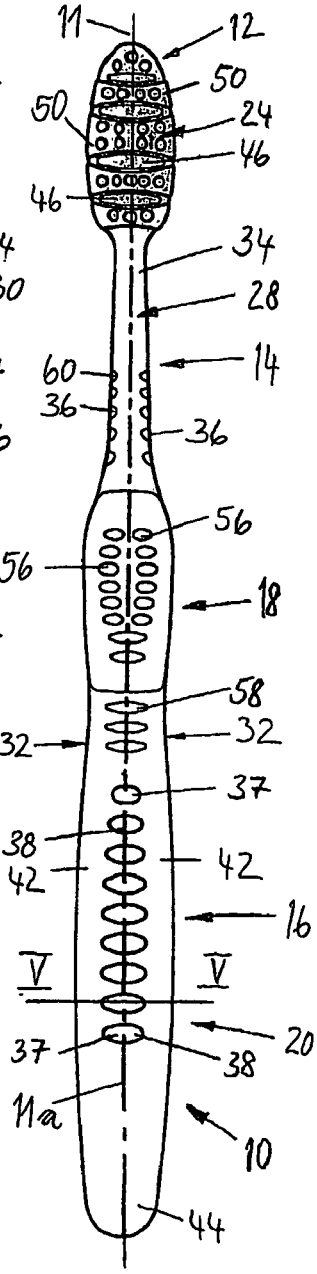
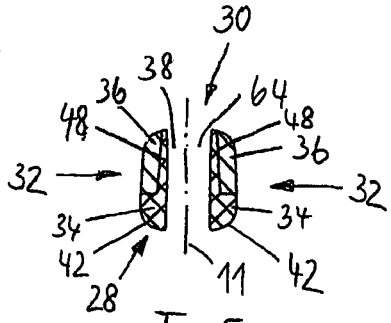
Fig. 5

Fig. 6
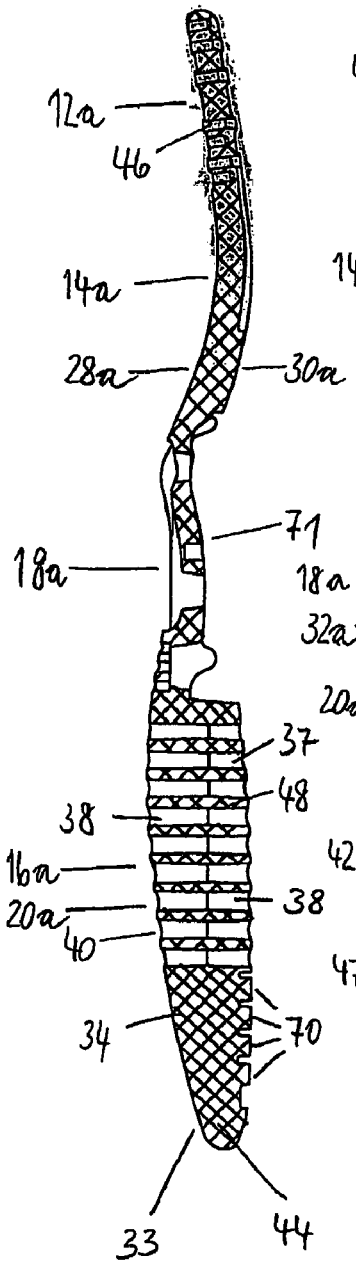
Fig. 7
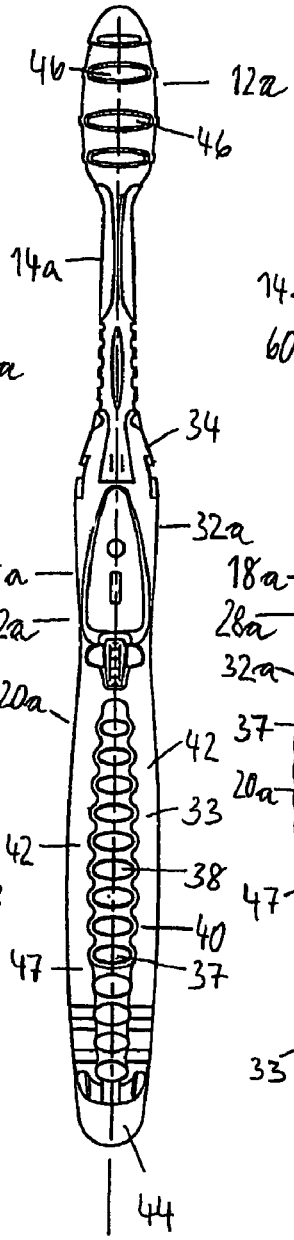
Fig. 8
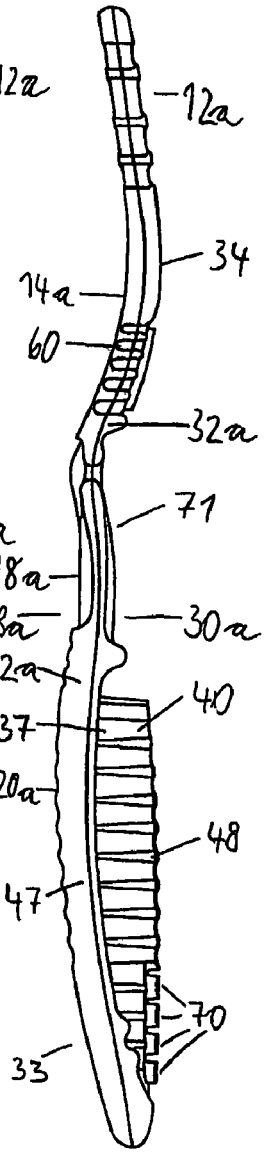
Fig. 9
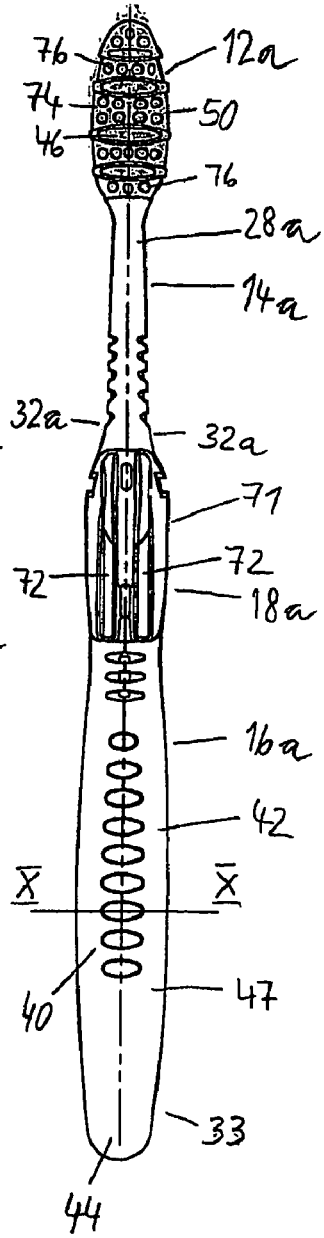
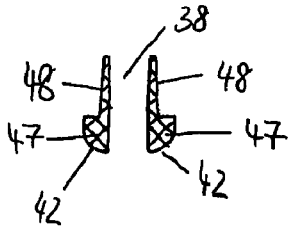
Fig. 10

Fig. 19
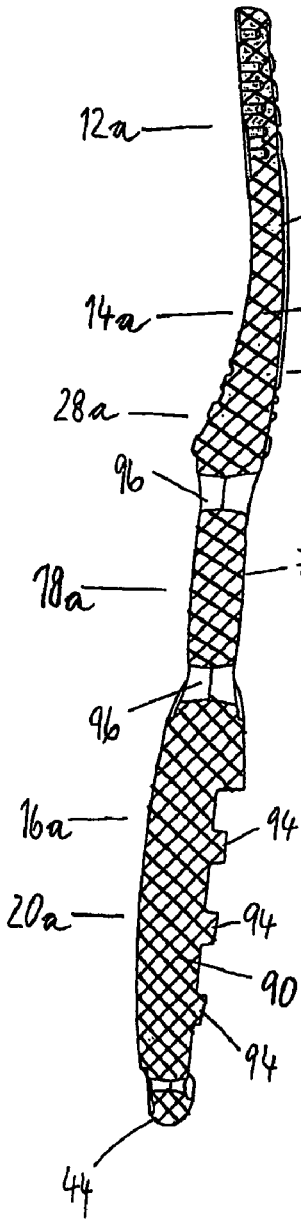
Fig. 20
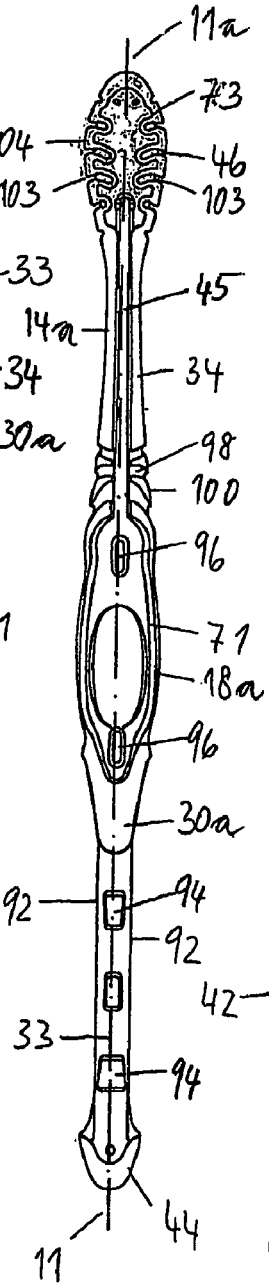
Fig. 21
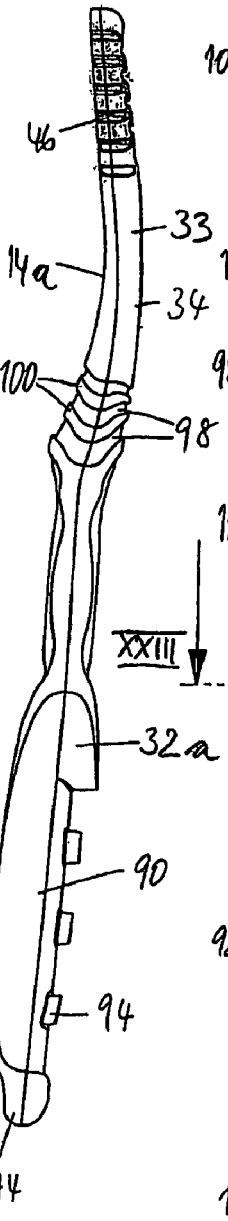
Fig. 22
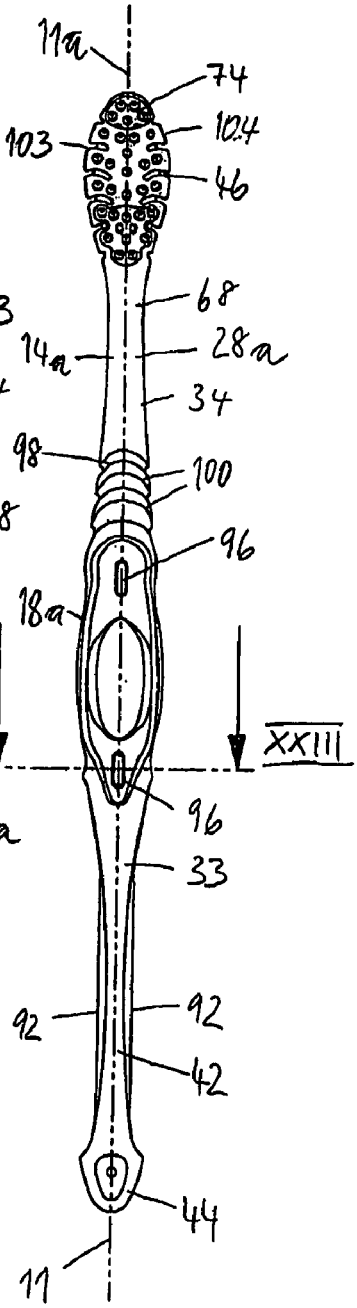
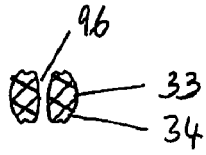
Fig. 23

TOOTHBRUSH WITH RECESSES

The invention relates to a toothbrush body.

Toothbrushes are well-known articles which are used daily for oral-hygiene purposes. They are generally divided up into a toothbrush body, comprising a head part, a neck part and a handle part, and bristles which are fitted on the head part.

A toothbrush having a bristle-carrying head part, a neck part and a handle part is described, for example, in DE-C-4222931. The handle part has a solid core with spaced-apart ribs which, together, form a sufficient gripping surface. The disk-like ribs are more or less square and, in order to form a thumb support, are enlarged at a handle-part end region which adjoins the neck part.

U.S. Pat. No. 6,286,173 discloses a toothbrush which has a two-piece, bristle-covered head part, a neck part and a handle part, on which three annular recesses are formed in order for fingers of the user's hand to engage therein. These recesses have a diameter which decreases as the distance from the head part increases. The axes of symmetry of the rings are located in a plane which runs parallel to the bristle-covered top side of the toothbrush.

EP-A-1397976 describes a toothbrush comprising a head part, a neck part and a handle part, the latter comprising two S-shaped segments arranged in opposite directions to one another. These form, in the handle part, two elongate recesses with lateral openings on two broad sides of the toothbrush.

U.S. Pat. No. 1,840,246 describes a toothbrush with spaced-apart prongs fitted with bristles or clusters of bristles formed on its head part, the intention being for the prongs to prevent toothpaste, toothpowder or similar substances, possibly contaminated with bacteria or food residues, from adhering to the head part.

U.S. Pat. No. 1,860,924 discloses a toothbrush with a head part provided with a series of grooves which run between clusters of bristles, essentially at right angles to the longitudinal axis of the toothbrush.

The head part of the toothbrush described in U.S. Pat. No. 6,016,587 is provided with a central through-hole. Bristles which are arranged at the through-hole, and are inclined in the direction of the through-hole, are intended to assist cleaning of the toothbrush.

WO-A-02/15740 discloses a toothbrush with a U-shaped recess on the head part. Hinge-like elements are located on both sides, at the free ends of this recess, and allow a bristle-covered portion of the head part to flex in relation to a further head-part portion, which is connected to the neck part and the handle part, and thus adapt itself to an individual tooth position.

The object of the present invention is to provide a voluminous, ergonomically advantageous and sufficiently stable handle part which, with minimal usage of materials, can be produced cost-effectively.

This object is achieved by a toothbrush body and a toothbrush having the features recited in the attached claims.

The basic idea of the toothbrush body according to the invention and of the toothbrush according to the invention is to provide a toothbrush body, on the top side of a palm-supporting section, with at least one longitudinal supporting strip which runs along the longitudinal axis of the handle part and alongside which at least one recess is located, the recess passing through from the top side to an underside. The recess may, on the one hand, be in the form of a hole which is arranged between two longitudinal supporting strips along the longitudinal axis of the palm-supporting section of the handle part or, on the other hand, be in the form of a lateral clearance which is open on a broadside and is adjacent to the longitudinal supporting strip. This results in the formation, on the toothbrush body according to the invention or the toothbrush according to the invention, of a voluminous handle part which, on account of the recesses, requires less material to be used in comparison with conventional handle parts and can thus be produced more cost-effectively. At the same time, the recesses reduce the weight of the toothbrush body and impart an ergonomically advantageous elasticity to the handle part.

In preferred embodiments, it is possible for a plurality of holes to be arranged in rows and for in each case at least two lateral clearances to be connected by means of a bottom clearance on the underside of the palm-supporting section, the bottom clearance being open on the underside, and thus to form ribs. In this way, for example water or contaminants which accumulate between the hand and the surface of the ribs are efficiently led away, and collected, in the channel-like clearances and the hand is prevented from slipping off the handle part.

In the case of a further preferred embodiment, the ribs are formed by a soft component, this providing an ergonomically shaped, soft-elastic and damping surface on the handle part. The pleasant feel of the handle part makes the toothbrush considerably more convenient and comfortable to use. The soft-elastic ribs, in addition, ensure improved adaptation of the handle part to different gripping positions, for example during cleaning of different regions of the oral cavity and during use by left-handed and right-handed individuals.

Particularly preferred embodiments are illustrated schematically in the following figures, in which:

FIG. 1 shows, in longitudinal section, a toothbrush body with a row of holes in a palm-supporting section and a basic structure made of a hard component, the basic structure carrying a soft component;

FIG. 2 shows a bottom view of the toothbrush body shown in FIG. 1;

FIG. 3 shows a side view of the toothbrush body which is shown in FIGS. 1 and 2 and is additionally provided with tongue-scraper bumps formed on the head part;

FIG. 4 shows a plan view of the toothbrush body shown in FIGS. 1 to 3;

FIG. 5 shows a cross section along line V-V through the toothbrush body shown in FIGS. 1 to 4, the cross section being taken in the region of a hole;

FIG. 6 shows a longitudinal section through a basic structure which is formed from the hard component and belongs to the toothbrush body shown in FIGS. 1 to 4;

FIG. 7 shows a bottom view of the basic structure shown in FIG. 6;

FIG. 8 shows a side view of the basic structure shown in FIG. 6;

FIG. 9 shows a plan view of the basic structure shown in FIG. 6;

FIG. 10 shows a cross section along line X-X through the basic structure shown in FIGS. 6 to 9, the cross section being taken in the region of a hole;

FIG. 19 shows, in longitudinal section, a further embodiment of a basic structure with a handle web and stubs projecting therefrom;

FIG. 20 shows a bottom view of the basic structure shown in FIG. 19;

FIG. 21 shows a side view of the basic structure shown in FIGS. 19 and 20;

FIG. 22 shows a plan view of the basic structure shown in FIGS. 19 to 21;

FIG. 23 shows a cross section along line XXIII-XXIII through the basic structure shown in FIGS. 19 to 22, the cross section being taken in the region of a thumb-supporting element;

Figures 11, 12, 13, 14, 15, 16, 17, 18:
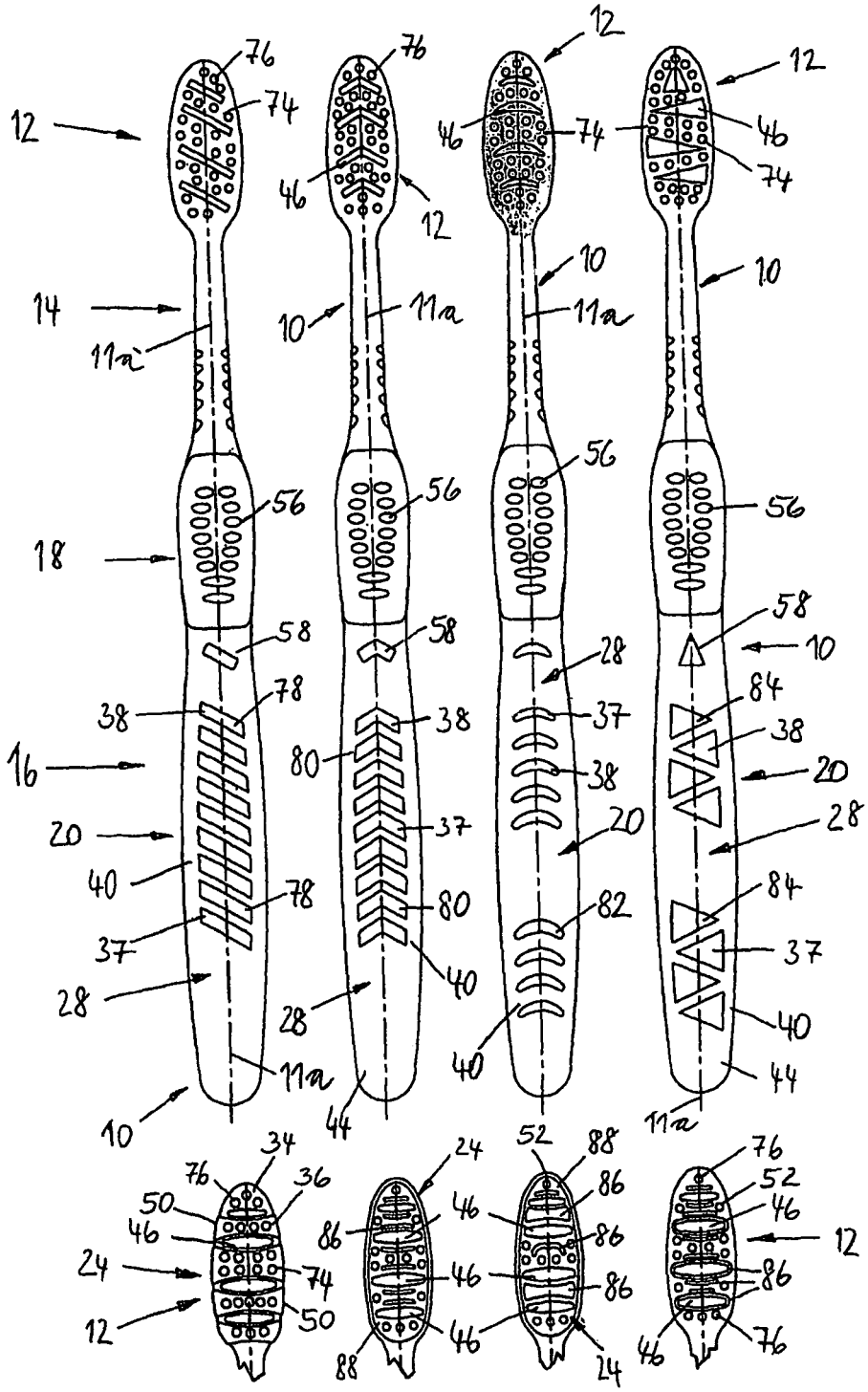
FIGS. 11 to 14 show plan views of toothbrush bodies with rows of holes of different cross-sectional shapes, and with further, geometrically similar recesses on their head parts.
FIGS. 15 to 18 show plan views of head parts of toothbrush bodies with different embodiments of cleaning and massage elements.
Figure 24:
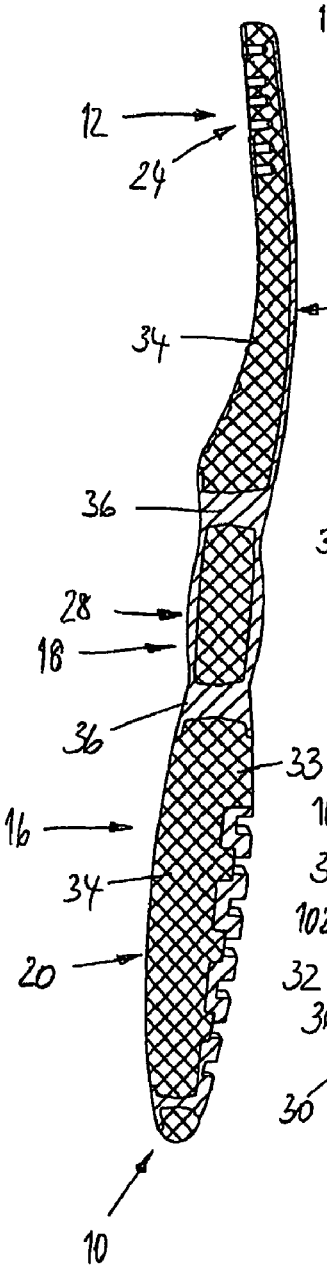
FIG. 24 shows a longitudinal section through a further embodiment of the toothbrush body with the basic structure which is shown in FIGS. 19 to 22 and, in this case, carries a soft component.

A first variant of a toothbrush body 10 according to the invention is shown in FIGS. 1 to 4. The toothbrush body 10 is made up of three parts which are arranged one after the other along a longitudinal axis 11*a*, running along its longitudinal center plane 11, and, in the embodiment shown, are connected integrally to one another, the three parts being a head part 12, a neck part 14 and a handle part 16. The handle part 16, in turn, is divided up into a thumb-supporting section 18 and a palm-supporting section 20. Bristles 22, which project from a bristle-accommodating side 24 of the head part 12 and, together with the toothbrush body 10, form a toothbrush 26, are shown in FIG. 3.

The head part 12 has a length of 20 mm to 40 mm. This corresponds to 10% to 20% of the overall length of the toothbrush 26. The slightly curved neck part 14 extends, from the head part 12 to the handle part 16, over a length of 20 mm to 60 mm, which corresponds to 20% to 30% of the overall length of the toothbrush 26. The handle part 16 runs, from the neck part 14 to the free end of the handle part 16, over a length of 80 mm to 120 mm, that is to say 40% to 60% of the overall length of the toothbrush 26. The thumb-supporting section 18 and the palm-supporting section 20 have a length of 20 mm to 60 mm and 60 mm to 120 mm, respectively.

In the region of the thumb-supporting section 18, the thickness of the toothbrush body 10, measured perpendicularly to the longitudinal axis 11*a*, is 5 mm to 15 mm. For ergonomic reasons, the thickness of the palm-supporting section 20 is greater, and is 7 mm to 20 mm. This gives an advantageous thickness ratio between the thumb-supporting section 18 and the palm-supporting section 20 of 1.2 to 4.

The toothbrush body 10 is bounded by a top side 28, comprising the bristle-accommodating side 24, an underside 30, which is located opposite the top side 28, and two broad sides 32, which extend from the top side 28 to the underside 30.

All the embodiments of the toothbrush body 10 which are described hereinbelow each have a basic structure 33 which is shown in FIGS. 6 to 10 and in FIGS. 19 to 23, is made of a hard component 34 and carries, at least in part, a soft component 36. In the sectional illustrations used, the hard component 34 is marked in each case by cross-hatching and the soft component 36 is marked by straightforward oblique hatching lines. Of course, embodiments which are produced solely from a hard component 34 or a soft component 36 or combinations of a number of hard components 34 or a number of soft components 36 are also possible.

As can be seen in FIG. 1, the palm-supporting section 20 is provided with nine recesses 37 in the form of through-holes 38 which extend from the top side 28 to the underside 30 and thus penetrate all the way through the handle part 16. In conjunction with FIG. 2, it is shown, in addition, that the holes 38 are spaced apart uniformly one behind the other and, in the process, form a rectilinear row 40 of holes. The row 40 of holes is enclosed between two longitudinal supporting strips 42 which are more or less smooth on the outer surface. The longitudinal supporting strips 42 extend from the thumb-supporting section 18 to a blunt end region 44 of the palm-supporting section 20. The holes 38 have oval cross sections, the diameters of which decrease in both directions from the center of the palm-supporting section 20, in relation to the longitudinal axis 11*a*, as the distance from the center increases.

The formation of recesses 37 in the palm-supporting section 20 provides a number of advantages, in particular ergonomic advantages, since the hand holding the toothbrush 26 is relieved of pressure at certain points, and this ensures better circulation through the palm, and hygienic advantages, since water, in particular also water contaminated with bacteria or dirt residues, can be led away from the handle part 16 to better effect during cleaning, which, in turn, enhances the grip of the toothbrush 26. Economic advantages are achieved, in particular, in that the material costs for the hard component 34 and the soft component 36 decrease on account of less material being used, and processing-related advantages are achieved, in particular, in that the production process, which preferably takes place by way of injection molding, preferably makes use of tools or molds which form easily interengaging cores which are supported against one another, this doing away with the occurrence of so-called blind holes.

In the case of the embodiment which is shown in FIGS. 1 to 4, all the holes 38 run through the longitudinal axis 11*a* at right angles. For the production process by way of the already mentioned injection molding, in which the cores of two mold halves meet essentially in the center of the holes 38 and thus form upright cores which are supported against one another, this makes it possible to have a single demolding direction for the mold halves. As an alternative, however, other orientations of the holes 38 in relation to the longitudinal axis 11*a* are also possible. Preferably a common demolding direction is likewise desired for slides which are used in this case, so that, following setting, as far as possible all the slides can be pulled out using a single slide mechanism. For stability reasons, the ratio of the overall volume of all the recesses 37 to the volume of the entire surrounding palm-supporting section 20 is less than 2:1. In addition, the holes 38 preferably have a greater extent in a direction perpendicular to the longitudinal axis 11*a*.

In order to prevent impressions from being formed in the hand during use of the toothbrush 26, there are no sharp edges or shoulders at the transition between the holes 38 and the longitudinal supporting strips 42 surrounding them. In the transition region, a rounding radius is less than 2 mm, and the holes 38 have an opening angle of between 10° and 45° there.

In order to improve the feel, as is shown in FIG. 3, wedge-shaped indents 54 are formed in the soft component 36 on the broad sides 32 in the palm-supporting section 20, oval bumps 56 are formed on the underside 30 and the top side 28 in the thumb-supporting section 18, and supporting elements 58 which are recessed or raised on both sides are formed in the boundary region between the thumb-supporting section 18 and palm-supporting section 20. The indents 54, bumps 56 and supporting elements 58 serve to allow the toothbrush 26 to be held securely in the user's hand and, by way of their contours, continue the geometrical shapes of the recesses 37 beyond the palm-supporting section 20.

Alongside regions on the top side 28 and the underside 30 of the cross-sectionally essentially rectangular thumb-supporting section 18, further regions made of the soft component 36 are formed in the neck part 14. On the broad sides 32 of the neck part 14, these regions are separated from the hard component 34 by an undulating boundary line 60, as is shown in FIG. 3. All the regions filled with the soft component 36 are preferably connected to one another by channels, for example a neck channel 45 (see FIG. 2), in the hard component 34, so that a single injection point for the soft component 36 is sufficient during the production process.

Further recesses 46 in the form of through-holes with an oval cross section and a geometric character similar to those of the recesses 37 of the palm-supporting section 20 are repeated on a smaller scale in the head part 12. This makes the user aware of an affinity between the configuration of the palm-supporting section 20, and the feel associated therewith, and the feeling of the cleaning action, influenced by the further recesses 46, in the mouth. In order likewise to give the further recesses 46 the character of the row 40 of holes, 2 to 9, preferably 3 to 6, of the further recesses 46 are formed in the head part 12.

The further recesses 46 have a maximum diameter perpendicularly to the longitudinal direction of the head part 12 of no more than 5 mm. Their longitudinal extent, however, is preferably between 1 mm and 3 mm. The ratio between the surface areas of the further recesses 46 on the top side 28 and the entire surface area of the bristle-accommodating side 24 should be less than 1:2, preferably less than 1:3. The further recesses 46 are preferably oriented in the same way as the recesses 37 in the palm-supporting section 20, and thus allow the same demolding direction for the mold halves during production.

The further recesses 46 result in the head part 12 being segmented, which can be seen clearly in FIGS. 2 and 4 in particular, into crosspieces 50, on which at least in each case one row of bristles 22 is placed.

As is shown in FIG. 3, the further recesses 46 are covered over, at least in part, by obliquely positioned bristles 22 or clusters 52 of bristles. Use is preferably made of X-form clusters or block-form clusters, in the case of which respectively adjacent bristles 22 and/or clusters 52 of bristles crossover and/or meet above the center of a further recess 46. The obliquely positioned clusters 52 of bristles assist interdental cleaning, that is to say, in particular, also cleaning of the spaces between the teeth. The bristles 22 of the X-form clusters are longer than bristles 22 projecting at least more or less at right angles from the bristle-accommodating side 24, and can project beyond the surrounding bristles 22.

The further recesses 46 in the head part 12 allow better rinsing of the bristles 22 when the toothbrush 26 is cleaned following use, and also a number of additional functions such as assisting in tongue cleaning and massaging the oral cavity and the gums.

For this purpose, massage and tongue-cleaning elements, and likewise tongue-scraper bumps 62 shown in FIG. 3, are formed from the soft component 36 on the underside 30 of the head part 12. They serve for cleaning the tongue and massaging the gums. The massage and tongue-cleaning elements preferably follow peripheries or further boundary lines between the soft component 36 and the hard component 34 or further recesses 46, which are present if need be.

FIG. 5 shows a cross section through the toothbrush body 10 which is shown in FIGS. 1 to 4, the cross section being taken along the section plane V-V which is marked in FIG. 4. The cross section through the handle part 16 is essentially square with rounded corners and a more or less rectangular cutout 64 corresponding to the sectioned hole 38. The cross section is symmetrical in relation to the longitudinal center plane 11. The sectioned longitudinal supporting strips 42 of the top side 28 and a sectioned hole wall 48 are marked by their hatching as being formed from the hard component 34; the broad side 32 is formed essentially by the soft component 36.

FIGS. 6 to 10 illustrate the basic carrying structure 33, made of the hard component 34, of the toothbrush body 10 which is shown in FIGS. 1 to 5. Following the pattern of the toothbrush body 10, the basic structure 33 is divided up into a head-part element 12*a*, a neck-part element 14*a* and a handle-part element 16*a*, which, in turn, comprises a thumb-supporting element 18*a* and a palm-supporting element 20*a*. The sides bounding it are referred to, likewise in conjunction with the sides of the toothbrush body 10, as structure top side 28*a*, structure underside 30*a* and structure broad sides 32*a*.

As can be seen in FIG. 8 in particular, the basic structure 33 has a slightly curved gripping plate 47, which forms at least more or less the entire top side 28 of the palm-supporting section 20 of the toothbrush body 10 including the blunt end region 44 of the latter, which is directed away from the head part 12, and the longitudinal supporting strip or strips 42. The hard component 34 is also used to form hole walls 48, which, projecting at least more or less at right angles from that side of the gripping plate 47 which is directed toward the underside 30, extend to the underside 30, and also platform-like extensions 70, which are arranged in rectilinear extension of the row 40 of holes, as far as the blunt end region 44, such that they project at least more or less at right angles from that side of the gripping plate 47 which is directed toward the underside 30 and extend more or less to the underside 30.

The palm-supporting element 20*a* of the basic structure 33 is formed in a block-like manner and encloses the row 40 of holes by way of the gripping plate 47 and the interconnected hole walls 48. In processing terms, this block-like part of the basic structure 33 provides for satisfactory support of the basic structure 33, with the recesses 37 contained therein, between the halves of the injection mold. A less preferred embodiment is one in which the hole walls 48 are separated and are not connected to one another along the longitudinal axis of the palm-supporting element 20*a*.

In order to allow straightforward filling of the entire mold cavity with the hard component 34, which extends over the entire length of the toothbrush body 10, and to avoid so-called sink marks as far as possible, during the production process, use is made, alongside the mold block forming the recesses 37, of a through-passage, for the initially fluid hard component 34, to the neck-part element 14*a* and to the head-part element 12*a*, the through-passage having a cross section of at least 5 $mm^2$, preferably of at least 10 $mm^2$.

As can be seen from FIGS. 6 and 8 in particular, the thumb-supporting element 18*a* is formed in a bridge-like manner between the block-like, and therefore stable, palm-supporting element 20*a* and the neck-part element 14*a*, which is more or less in the form of a solid body. The thumb-supporting element 18*a* here is considerably wider in respect of the structure top side 28*a* and the structure underside 30*a* than it is thick in respect of the structure broad sides 32*a*.

As is shown in FIG. 9, the thumb-supporting element 18*a* is provided, on the structure top side 28*a*, with two rail-like webs 72 which run parallel along the longitudinal axis of the thumb-supporting element 18*a* and are curved slightly in the direction of the structure underside 30*a*. The webs 72 serve for accommodating, with lateral stability, the soft component 36, which ends up located above them, and, since they can be felt through the soft component 36, they allow the toothbrush 26 to be guided in a precise manner.

The bridge-like formation of the thumb-supporting element 18*a* additionally ensures sufficient elasticity of the head part 12 in relation to the handle part 16 and prevents the gums from being subjected to excessively pronounced levels of pressure from the forces transmitted to the bristles 22.

The basic structure 33 widens in a spatula-like manner from the neck-part element 14*a*, which adjoins the thumb-supporting element 18*a*, to the rounded head-part element 12*a*. The further recesses 46 and a number of blind holes 76, forming an area 74 of holes, for accommodating clusters 52 of bristles are arranged on the head-part element 12*a*.

FIG. 10 illustrates a section through the palm-supporting element 20*a* which is shown in FIG. 9, the section being taken along section plane X-X which is marked in FIG. 9. The sectional illustration shows the regions of the hard component 34 according to FIG. 5. This figure shows sectioned surfaces of the hole wall 48 and of the gripping plate 47, the sectioned surfaces being symmetrical in relation to the longitudinal axis of the sectioned hole 38.

FIGS. 11 to 14 show top sides 28 of different toothbrush bodies 10 with different geometrical shapes of hole 38. In addition to the oval cross-sectional shape of holes 38 which is presented in FIGS. 1 to 10, it is also possible to have further straightforward basic geometrical shapes, but also complex combinations of shapes in a continuous or interrupted row of from 3 to 30, but preferably from approximately 7 to 12, holes 38. It is preferable here for the cross-sectional shapes of the recesses 37 of the palm-supporting section 20 to be repeated, with modified sizing, in the head part 12. In addition to arranging holes 38 of the same basic geometrical shape on a toothbrush body 10, it is also possible to form holes 38 of different basic shapes on a toothbrush body 10. Interruptions in rows of holes 38 are suitable particularly for providing text. It is preferable, as is shown for example in FIGS. 13 and 14, for such an interruption to be arranged in a central region of the palm-supporting section 20.

The holes 38 which are shown in FIG. 11 are in the form of a parallelogram 78, the longitudinal sides of which enclose an angle with the longitudinal axis 11*a*. The embodiment of FIG. 12 has an arrow head 80, FIG. 13 has a sickle 82, and FIG. 14 has a triangle 84, as the recurring basic shape arranged in rows 40 of holes.

The overall surface area of a recess 37 on the top side 28 is between 10 $mm^2$-200 $mm^2$, preferably 20 $mm^2$-50 $mm^2$. The size and the shape of the individual recesses 37 allows the straightforward rinsing of the holes 38 for the purpose of cleaning the toothbrush 26 and, at the same time, rules out a capillary action for water and contaminants. As seen from the top side 28, the longitudinal axes of the basic shapes are preferably arranged at right angles to the longitudinal axis 11*a*. The minimum material thickness between two holes 38 of the palm-supporting section 20 should not fall below 0.3 mm. For stability reasons, it is preferably 0.8 mm to 3 mm.

FIGS. 15 to 18 illustrate further embodiments, this time with further recesses 46 of oval shape in head parts 12.

The already mentioned crosspieces 50 are shown, once again, on the head part 12 in FIG. 15, the crosspieces consisting entirely of the soft component 36, or of a combination of the hard component 34 and of the soft component 36, and extending from the bristle-accommodating side 24, via the broad sides 32, and over the underside 30 of the head part 12.

For the segmentation of the head part 12 into the crosspieces 50, it is likewise possible to have an embodiment in which the segments formed can be deflected in a flexible manner in relation to one another. The flexibility here is achieved by very specific material weakening in the hard component 34 between the crosspieces 50 for the purpose of forming hinge-like transition zones. If the material weakening takes place only in the hard component 34, then a minimum material thickness of less than 3 mm, preferably of less than 1 mm, is recommended. However, the material weakening is preferably located in a region where the hard component 34 and soft component 36 are interconnected. As an alternative, however, it is possible, during the production process, for lateral passageways, tubes or tunnels to be formed in the transition zones by means of lateral slides and then to be filled with the soft component 36.

In FIG. 15, the soft component 36 is offset slightly by 0.1 mm to 1 mm from the hard component 34. As an alternative, it is also possible, as a result of the soft component 36 being incorporated completely in the hard component 34, for essentially stepless transitions to be formed between the hard component 34 and the soft component 36, this effectively preventing dirt and water from accumulating at the transitions.

On the bristle-accommodating side 24, one or two rows of clusters 52 of bristles (not shown) pass through the soft component 36. The layer-thickness ratio of the soft component 36 to the hard component 34 here is preferably less than 1:3. This ensures that, when the bristles 22 are being fitted by way of a conventional bristle-tufting process, by means of anchor plates, it is possible to punch through a layer of the soft component 36.

In FIGS. 16 to 18, rubber-elastic cleaning and massage elements 86 formed from the soft component 36 and/or rows of bristles 22 fastened in the blind holes 76 are fitted on the bristle-accommodating side 24. They may be in the form of sickles, as is shown in FIGS. 16 and 18, or of pads, as is shown in FIG. 17. The cleaning and massage elements 86 and/or rows of bristles are preferably arranged between the further recesses 46 in the head part 12 and/or between clusters 52 of bristles. They generally have a greater extent at right angles to the longitudinal axis of the head part 12 than in the direction parallel to this longitudinal axis. It is further possible, as is shown in FIG. 18, for the cleaning and massage elements 86 and/or rows of bristles essentially to follow, at least in part, peripheries of the further recesses 46. The spacing here between the peripheries of the further recesses 46 and the cleaning and massage elements 86 and/or rows of bristles in the vicinity is less than 2 mm, preferably less than 1.2 mm.

For covering the head part 12 with bristles, it is preferred to use bristle-covering processes which, in addition to the classic clusters 52 of bristles, can produce thin rows of bristles 22. Use is made here, for example, of in-mold tufting (IMT), as described in EP-A-0 346 646, or anchor free tufting (AFT), as disclosed in DE-U-20006311. In the case of AFT, as is shown in FIGS. 16 and 17, bristle-carrier plates 88, which carry bristles 22, are fastened on the bristle-accommodating side 24 of the head part 12. The bristle-carrier plate 88 here is located snugly in a form-fitting manner in a corresponding depression of the head part 12 or is adhesively bonded or welded therein, in order to prevent water or contaminants from penetrating into the depression. As an alternative, it is also possible for clusters 52 of bristles produced for a blind-hole diameter of less than 1.6 mm to be arranged in rows one beside the other using a conventional tufting process.

FIGS. 19 to 23 present a further embodiment of a basic structure 33, formed from the hard component 34, for a second variant of the toothbrush body 10. It is provided with an elongate, plate-like handle web 90 which extends along the longitudinal center plane 11 in the palm-supporting section 20, between the top side 28 and the underside 30, from the thumb-supporting section 18 to the blunt end region 44 of the palm-supporting section 20. On its central part, the handle web 90 has projecting stubs 94 directed toward the underside 30 of the toothbrush body 10.

The handle web 90, as measured perpendicularly to the longitudinal center plane 11, has a thickness of from 4 mm to 8 mm. It tapers on the structure top side and forms the longitudinal supporting strip 42 on the top side 28 of the toothbrush body 10 (see FIGS. 24 to 27). The plate-like formation of the handle web 90 provides the palm-supporting section 20 of the toothbrush body 10 with a flexibility which is dependent on the thickness of the handle web 90, so that the handle web can be deflected perpendicularly to the longitudinal center plane 11 by the user and the handle part 16 adapts itself optimally to specific hand shapes of right-handed and left-handed individuals. Flexibility in a direction parallel to the longitudinal center plane 11 is essentially ruled out by the handle web 90 having a height of from 10 mm to 15 mm. The ratio between the height and the width of the handle web 90 is preferably greater than 2:1.

In its central part, the handle web 90 has three stubs 94, which project in the direction of the structure underside 30*a*. The stubs 94 serve for securing the basic structure 33 in the mold halves during injection-molded encapsulation by the soft component 36.

As is shown in FIGS. 20 and 22, the thumb-supporting element 18*a* is of essentially oval formation perpendicularly to the longitudinal plane 11 and tapers along the longitudinal sides to form something of a narrowed portion in its two end regions. Conversely, the cross section of the thumb-supporting element 18*a* thickens in the direction of its two end regions along the longitudinal center plane 11.

In each case one slot 96 is made longitudinally in the two end regions of the thumb-supporting element 18*a* and passes through from the structure top side 28*a* to the structure underside 30*a*. The neck-part element 14*a* extends, as a slightly curved solid body, from the thumb-supporting element 18*a* to the head-part element 12*a*, where it widens in a spatula-like manner in order to accommodate bristles 22. According to FIGS. 20 to 22, four neck grooves 98, which run part of the way round, are formed on the neck-part element 14*a*, following the thumb-supporting element 18*a*. These neck grooves 98, in turn, form neck ribs 100 which, on the toothbrush body 10, are filled with the soft component 36 (see FIGS. 25 to 27). FIG. 20 shows a further configuration of the open neck channel 45 on the structure underside 30*a*.

As can be seen to good effect in FIGS. 20 and 22 in particular, gap-like further recesses 46 are formed on the head-part element 12*a*, and these will be discussed in detail in conjunction with the following description of the associated toothbrush body 10.

FIG. 23 shows a cross section along line XXIII-XXIII through the basic structure 33 which is shown in FIGS. 19 to 22, the cross section being taken in the region of the thumb-supporting element 18*a*. This figure illustrates two oval sectioned surfaces of the hard component 34 which are spaced apart from one another by the slot 96.

FIGS. 24 to 27 present an embodiment of the toothbrush body 10 which has been produced by virtue of the soft component 36 being applied to the basic structure 33 which is shown in FIGS. 19 to 23. As can be seen to particularly good effect in FIGS. 25 to 27, it has, in the palm-supporting section 20, recesses 37 in the form of lateral clearances 102 which are open on the broad side 32 and pass through from the top side 28 to the underside 30. On the top side 28, the clearances 102 are adjacent to the longitudinal supporting strip 42 formed from the hard component 34 (see FIG. 27). The clearances 102 are continuous from the top side 28 to the underside 30 over a depth of up to 7 mm.

Figure 25:
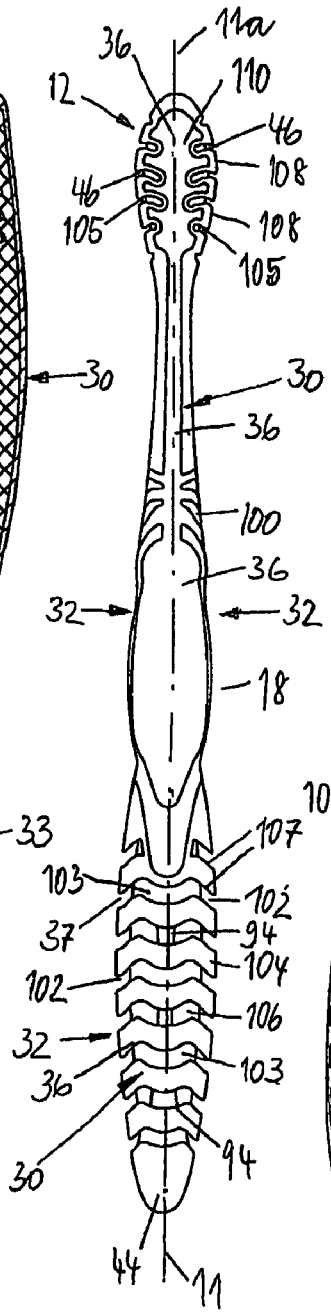
FIG. 25 shows a bottom view of the toothbrush body shown in FIG. 24.
Figure 26:
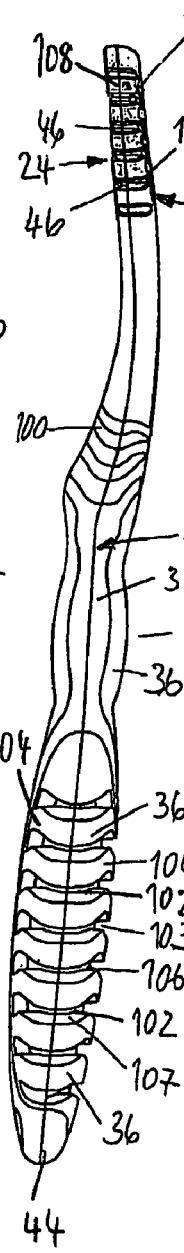
FIG. 26 shows a side view of the toothbrush body shown in FIGS. 24 and 25.

As is shown in FIG. 25, in each case two lateral clearances 102, located opposite one another in relation to the longitudinal center plane 11, are connected on the underside 30, in the palm-supporting section 20, by means of a bottom clearance 103, which is open on the underside 30 and undulates preferably in an M-shaped manner in order to improve ergonomics. A plurality of the groove-like lateral and bottom clearances 102, 103 arranged one behind the other in the longitudinal direction of the palm-supporting section 20 form ribs 104 from the soft component 36, these ribs projecting from bases 106 of the lateral and bottom clearances 102, 103. Edges of the ribs 104 are rounded.

Figure 27:
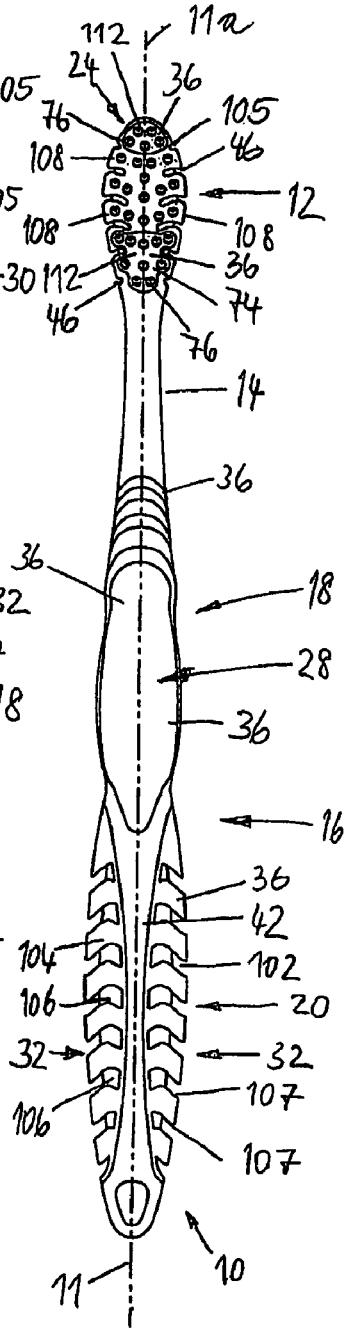
FIG. 27 shows a plan view of the toothbrush body shown in FIGS. 24 to 26.

According to FIGS. 25 and 27, the ribs 104 are positioned obliquely, along the broad sides 32, in relation to the longitudinal center plane 11 and enclose an acute angle, as measured in the direction of the blunt end region 44, which is less than 90°, and is preferably 45°. The ribs 104, which are formed from the soft component 36, are laterally flexible and adapt themselves optimally to the user's hand.

The width of the ribs 104, as measured parallel to the longitudinal axis 11*a*, is 2 mm to 10 mm, preferably 5 mm. The width of the bases 106 of the clearances 102 and the lateral spacing between the ribs 104 are less than the outer width of the ribs 104 along the broad sides 32. Despite the lateral and bottom clearances 102, 103, which reduce the amount of material used, this gives the user the feeling of holding a voluminous handle part 16.

The lateral and bottom clearances 102, 103 run continuously over approximately 95%, but at least over 75%, of the radial circumstance and are interrupted on the top side 28, along the longitudinal axis 11*a*, by the longitudinal supporting strip 42. The lateral and bottom clearances 102, 103 form drainage channels through which water can flow off from the palm during cleaning. Furthermore, the ribs 104, which are open in the direction of the blunt end region 44, considerably reduce the risk of the hand slipping off from the handle part 16 in the direction of the head part 12 during teeth cleaning.

The lateral clearances 102, which are open in the direction of the broad sides 32, are formed during the production process by upright mold-half cores which meet essentially in the center of the workpiece. In addition, the lateral clearances 102 are all oriented in a demolding direction, so that there is preferably no need for any additional lateral slides to be used for producing the toothbrush body 10.

In the case of the essentially fir-cone-like palm-supporting section 20 which is shown in FIGS. 24 to 27, apart from the longitudinal supporting strip 42, the blunt end region 44 and the outer surfaces of the stubs 94 (see FIG. 25), most of the surface area is formed from the soft component 36. The ratio of the volume of the hard component 34 to that of the soft component 36 in this section is less than 1:2, preferably approximately 1:3.

In the case of this embodiment, text (not shown) may be provided on the broad side 32 of the thumb-supporting section 18. The text is formed during production, by cooperating lateral slides, directly during injection molding or in a hot embossing process, which is preferably carried out during the bristle-covering process. Mold parting surfaces or edges are preferably avoided in the text panel by offset mold halves or slides which are offset in this region.

As is illustrated in FIGS. 25 and 27, the head part 12, beginning from the broad sides 32 in each case, has 6 further recesses 46 in the form of further clearances 105 and thus assumes the geometric character of the palm-supporting section 20. Lateral head-part ribs 108 formed in this way likewise open at an acute angle, in relation to the longitudinal axis of the head part 12, in the direction of the handle part 16. The opening angle between the individual head-part ribs 108 can vary and, in the case of most head-part ribs 108, is likewise less than 90°.

The depth of the further clearances 105 in the head part 12, as measured from the broad sides 32 of the head part 12, is less than 5 mm, preferably between 0.3 mm and 3 mm. They do not pass through the longitudinal axis of the head part 12. Similarly to the lateral and bottom clearances 102, 103 in the palm-supporting section 20, the further clearances 105, and thus also the head-part ribs 108, are not formed all the way round. As is shown in FIG. 25, they end at a longitudinal head strip 110 on the underside 30 of the head part 12. In the case of an alternative embodiment, which is not illustrated here, the further clearances 105 and the head-part ribs 108 run all the way round and form separate segments on the underside 30 of the head part 12 and possibly also on the neck part 14. For the case where the further clearances 105 are of sufficiently deep configuration laterally and on the underside 30, the individual segments may be deflected flexibly in relation to one another and/or execute a torsional movement in relation to one another.

On the bristle-accommodating side 24, the head-part ribs 108, which are formed on each broad side 32, have at least a width sufficient for accommodating a cluster 52 of bristles.

In the preferred embodiment shown, the head-part ribs 108 comprise a combination of the hard component 34 and of the soft component 36. The soft component 36 preferably has a layer thickness of between 0.3 mm and 3 mm, preferably approximately 1 mm, on the bristle-accommodating side 24 and is recessed in the head part 12 over the entire underside 30 of the head part 12. This prevents dirt from building up in the transition region between the hard component 34 and the soft component 36. In the case of the embodiment which is shown in FIGS. 24 to 27, the layer of the soft component 36 on the bristle-accommodating side 24 is raised slightly.

The flexibility of the head-part ribs 108 can be influenced by the layer thickness of the soft component 36. It is also conceivable, for example, for them to be formed entirely from the soft component 36. As an alternative, it is also possible to provide a profile of layer thicknesses for the soft component 36. In this case, for example, the profile could slope in the outward direction and thus increase the flexibility of the head-part ribs 108.

In the case of the embodiments shown, the bristles 22 are anchored in blind holes 76 of the basic structure 33 and penetrate all the way through the layer of the soft component 36 in each case. Of course, the head part 12 may also be produced by means of the AFT and IMT bristle-covering processes which were previously cited as alternatives.

As FIG. 27 shows, two interconnected, preferably film-like sub-surfaces 112 are formed from the soft component 36 on the bristle-accommodating side 24. As an alternative, however, it is also possible for just one sub-surface 112 or up to five sub-surfaces 112 to be formed from the soft component 36. During production by injection molding, the soft component 36 for these regions, which form the sub-surfaces 112, is fed through head-part channels (not shown) extending from the underside 30 of the head part 12. There is no need for any material connection via the broad sides 32 of the head part 12.

Rubber-elastic cleaning and massage elements 86 likewise consisting of the soft component 36 may be formed to project from, and to be anchored in, the sub-surfaces 112.

As is already the case with the previously described embodiments, slides are also used in this embodiment, during production of the further recesses 46 in the head part 12, for the case where the further recesses 46 are angled in relation to the handle part 16. Furthermore, the further recesses 46 in the head part 12 and the pattern 74 of holes accommodating the clusters 52 of bristles are preferably formed such that, during their production, the demolding directions of the mold halves are essentially the same and it is thus possible to use the same slide mechanism.

Around the further recesses 46 in the head part 12, the bristles 22 or clusters 52 of bristles may, similarly to the embodiments described above, be oriented obliquely in relation to the further recesses 46. It is likewise possible, as has been described previously, for massage and tongue-cleaning elements, for example the tongue-scraper bumps 62, to be provided on the underside 30 of the head part 12 preferably adjoining, or adjacent to, peripheries of the further recesses 46 and/or of the crosspieces 50.

Production of the toothbrush body 10 according to the invention and/or of the toothbrush 26 according to the invention takes place by means of injection molding, essentially in accordance with the steps mentioned hereinbelow:

1. Injection molding the basic structure 33 from the hard component 34 by means of mold halves, which possibly form upright cores, and possibly by means of slides
2. Once the hard component 34 has solidified, pulling out the cores and/or slides
3. Transferring the basic structure 33 made of the hard component 34 into a mold cavity for the soft component 36 and then possibly moving the cores and/or slides part of the way in in order to support recesses 37 and further recesses 46 against injection pressure and temperature-induced changes in shape
4. Injecting the soft component 36
5. Once the soft component 36 has solidified, pulling out the cores and/or slides and fully demolding the toothbrush body 10
6. Secondary finishing, bristle-covering and quality control Prior to injecting the hard component 34, the mold halves are brought together, in order to form upright cores, such that they meet essentially in the center of the volume of the mold. During subsequent injection molding of the soft component 36, in some cases cores and/or slides are pushed only part of the way into the hard component 34.

Toothbrush bodies 10 and/or toothbrushes 26 in which the recesses 37 and further recesses 46 are oriented in the same demolding direction prove to be advantageous from a production point of view.

The orientation and the arrangement as well as the size and shape of the recesses 37 and of the further recesses 46 here determine the flexibility of the finished toothbrush 26. Alongside these different ways of weakening the material, the flexibility is also determined by the material composition of the toothbrush 26.

In the case of the toothbrush body 10 according to the invention, the hard component 34 is produced, for example, from styrene-acrylonitrile (SAN), polyester (PET), polymethyl methacrylate (PMMA) and acrylonitrile-butadiene-styrene (ABS), but preferably from polypropylene (PP). The soft component 36 used is a rubber-elastic material such as polyurethane (PUR), preferably a thermoplastic elastomer (TPE) or a thermoplastic elastomer based on polyurethane (TPU).

The specific configuration of the handle part 16 and the production thereof could also be used analogously for other everyday products, in particular for handles of wet shavers.

The invention claimed is:

1. A toothbrush body comprising one after the other, along a longitudinal axis running along a longitudinal center plane:

a head part having a bristle-accommodating side;

a neck part; and a handle part, the toothbrush body being bounded by a top side comprising the bristle-accommodating side, an underside located opposite the top side, and two broad sides extending from the top side to the underside, the toothbrush body being formed from at least one hard component and at least one soft component, the at least one hard component functioning as a basic carrying structure for the at least one soft component, the basic carrying structure comprising:

a neck-part element; and a handle-part element, the handle-part element comprising two supporting strips running substantially parallel to the longitudinal axis and a row of recesses arranged between the supporting strips, the recesses passing through from a structure top side of the basic carrying structure to a structure underside of the basic carrying structure, the basic carrying structure forming hole walls of the recesses, and the at least one soft component being injection-molded at the hole walls and forming at least a part of the two broad sides.

2. The toothbrush body as claimed in claim 1, wherein the supporting strips form a palm-supporting element.

3. The toothbrush body as claimed in claim 2, wherein the palm supporting element comprises a blunt end region directed away from the head part.

4. The toothbrush body as claimed in claim 3, wherein the hard component extends over an entire length of the of the toothbrush body.

5. The toothbrush body as claimed in claim 4, wherein regions of the top side and the underside are made of the soft component.

6. The toothbrush body as claimed in claim 5, wherein the broad sides are formed essentially by the soft component.

7. The toothbrush body as claimed in claim 6, wherein all regions filled with the soft component are connected.

8. The toothbrush body as claimed in claim 3, wherein the basic carrying structure forms a slightly curved gripping plate.

9. The toothbrush body as claimed in claim 8, wherein the hard component extends over an entire length of the of the toothbrush body.

10. The toothbrush body as claimed in claim 1, further comprising at least one of indents, bumps, recessed supporting elements and raised supporting elements formed in the soft component.

11. The toothbrush body as claimed in claim 1, wherein the handle part is divided up into a thumb-supporting section directed toward the neck and an adjoining palm-supporting section, and a thickness of the toothbrush body in a region of the palm-supporting section is greater than a thickness in the thumb-supporting section.

12. The toothbrush body as claimed in claim 11, further comprising at least one of indents, bumps, recessed supporting elements and raised supporting elements formed in the soft component.

13. The toothbrush body as claimed in claim 1, wherein regions of the top side and the underside are made of the soft component.

14. The toothbrush body as claimed in claim 13, wherein further regions of the soft component are formed in the neck part.

15. The toothbrush body as claimed in claim 14, wherein the broad sides are formed essentially by the soft component and all regions filled with the soft component are connected.

16. The toothbrush body as claimed in claim 1, wherein the broad sides are formed essentially by the soft component.

17. The toothbrush body as claimed in claim 1, wherein the hard component is produced by a hard plastic material and the soft component is produced from a relatively softer elastic material.

18. The toothbrush body as claimed in claim 17, wherein the hard plastic material is polypropylene.

19. The toothbrush body as claimed in claim 17, wherein the relatively softer elastic material is a thermoplastic elastomer.

* * * * *